US006739475B2

(12) United States Patent
San Martin et al.

(10) Patent No.: US 6,739,475 B2
(45) Date of Patent: May 25, 2004

(54) CONTAINERS FOR ARTICLES OF FROZEN CONFECTIONERY

(75) Inventors: Jesus San Martin, Barcelona (ES); Miguel Ruano Del Campo, Barcelona (ES); Eduardo Domenech Sendra, Valenzia (ES); Jorge Bueno Ceresuela, Barcelona (ES)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 10/179,852

(22) Filed: Jun. 26, 2002

(65) Prior Publication Data

US 2002/0166870 A1 Nov. 14, 2002

Related U.S. Application Data

(62) Division of application No. 09/688,547, filed on Oct. 6, 2000, now Pat. No. 6,431,395, which is a continuation of application No. PCT/EP99/02418, filed on Apr. 6, 1999.

(30) Foreign Application Priority Data

| | | |
|---|---|---|
| Apr. 16, 1998 | (ES) | 9801015 U |
| Jul. 14, 1998 | (ES) | 9801875 U |
| Aug. 28, 1998 | (ES) | 9801826 |

(51) Int. Cl.[7] ..... A24F 27/14; B65D 6/28

(52) U.S. Cl. ..... 221/150 R; 220/4.23; 220/4.24; 220/833; 220/839; 220/659

(58) Field of Search ..... 220/810, 833, 220/836, 837, 839, 842, 659, 4.21, 4.22, 4.23, 4.24, 4.04; 312/42, 45, 72; 221/1, 150 R; 62/155, 156

(56) References Cited

U.S. PATENT DOCUMENTS

| | | | | |
|---|---|---|---|---|
| 1,771,933 A | | 7/1930 | Lehrman | |
| 2,176,823 A | * | 10/1939 | Richardson | 221/150 R |
| 2,739,751 A | | 9/1956 | Bailey | 229/15 |
| 2,798,784 A | * | 7/1957 | Marshall | |
| 3,043,354 A | * | 7/1962 | Fitzgerald | |
| 3,215,300 A | | 11/1965 | Lynch | 220/4 |
| 3,507,417 A | * | 4/1970 | McCarthy et al. | |

(List continued on next page.)

FOREIGN PATENT DOCUMENTS

| | | |
|---|---|---|
| CH | 494 683 | 5/1969 |
| DE | 109 798 | 12/1898 |
| DE | 3220605 A1 | 12/1983 |
| EP | 0 017 276 | 8/1984 |
| EP | 0 182 416 | 6/1986 |
| EP | 0 474 911 A1 | 3/1992 |
| FR | 1 492 266 | 8/1967 |
| JP | 404291491 A | 10/1992 |
| JP | 405046861 A | 2/1993 |
| WO | WO 96/33477 | 10/1996 |

*Primary Examiner*—David H. Bollinger
(74) *Attorney, Agent, or Firm*—Winston & Strawn LLP

(57) ABSTRACT

The present invention relates to containers and their use in an automatic vending machine that vends articles of frozen confectionery. The vending machine includes an outer body, an outer door, and an environment-controlled chamber. The containers are of cylindrical, quasi-cylindrical or polyhedral shape to contain the frozen confectionery. The machine has an environment-controlled chamber maintained at about −18° C. and has insulating panels and an inner door, the machine being maintained by a refrigeration system and a defrost system. Within the chamber are vertical compartments for the storage of stacked containers, a dispensing device, and a discharge hopper leading to an outlet tray. In the outer door there are product selection and cash box mechanisms that monitors not only the amount or number of articles of frozen confectionery but also the amount of money inserted and dispensed. The machine can be connected by telephone to a central service to request restocking or to communicate any malfunction or damage to the machine. The mechanisms can be used to provide advertising and dispense prizes.

23 Claims, 4 Drawing Sheets

U.S. PATENT DOCUMENTS 3,511,433 A * 5/1970 Andrews et al.
3,786,982 A * 1/1974 Rakes et al.
4,323,169 A * 4/1982 Guigan ..... 221/124
4,444,795 A 4/1984 Weinstein ..... 456/90
4,722,455 A 2/1988 Groover ..... 221/131
4,863,054 A 9/1989 Capetta ..... 220/4
4,890,786 A 1/1990 Oberhofer et al. ..... 229/5.7
5,027,698 A 7/1991 Chirnomas ..... 99/450.1
5,176,272 A 1/1993 Ryan ..... 222/4.23
5,333,754 A * 8/1994 Kobayashi ..... 221/150 R
5,515,993 A * 5/1996 McManus
5,516,002 A 5/1996 Motillo ..... 221/150 HC
5,553,753 A 9/1996 Abplanalp ..... 222/387
5,590,809 A 1/1997 Prescott et al. ..... 221/132
5,613,620 A 3/1997 Center et al. ..... 221/133
5,642,810 A * 7/1997 Warner et al.
5,671,604 A 9/1997 Rudick ..... 62/52.1
5,738,243 A 4/1998 Broadstreet ..... 221/7
5,769,269 A 6/1998 Peters ..... 221/7
5,799,822 A 9/1998 Rudewicz ..... 221/150
5,901,877 A 5/1999 Fujiu ..... 221/150 HC
5,938,068 A * 8/1999 Atkins et al.
5,957,275 A * 9/1999 Lemaire
6,006,945 A * 12/1999 Kirkland
6,112,534 A * 9/2000 Taras et al. ..... 62/217
6,155,455 A 12/2000 Yajima et al. ..... 221/131
6,247,612 B1 * 6/2001 Kaufman
6,431,395 B1 * 8/2002 San Martin et al.

* cited by examiner

FIG. 1
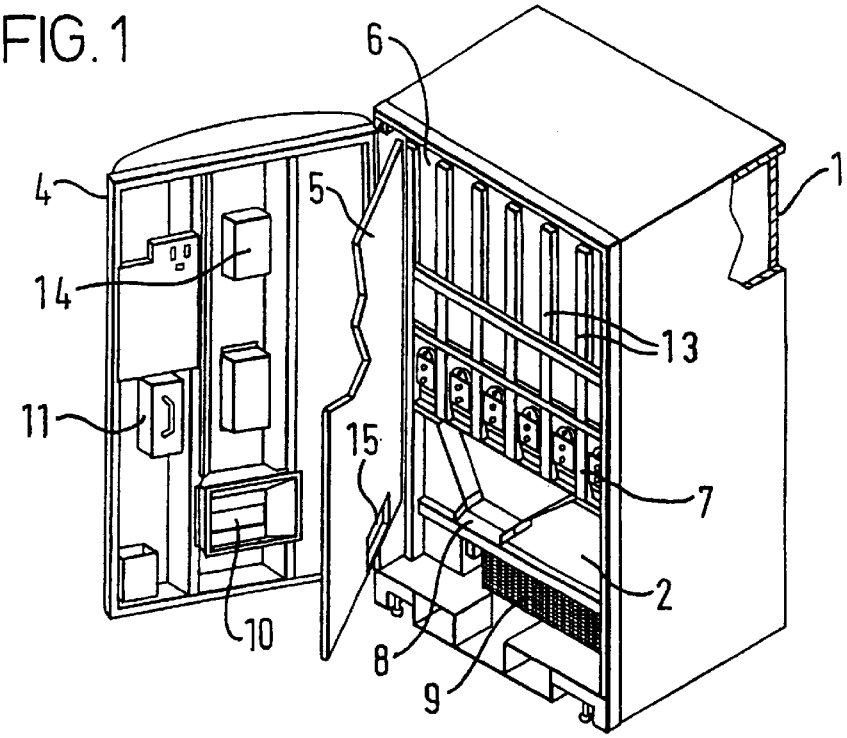
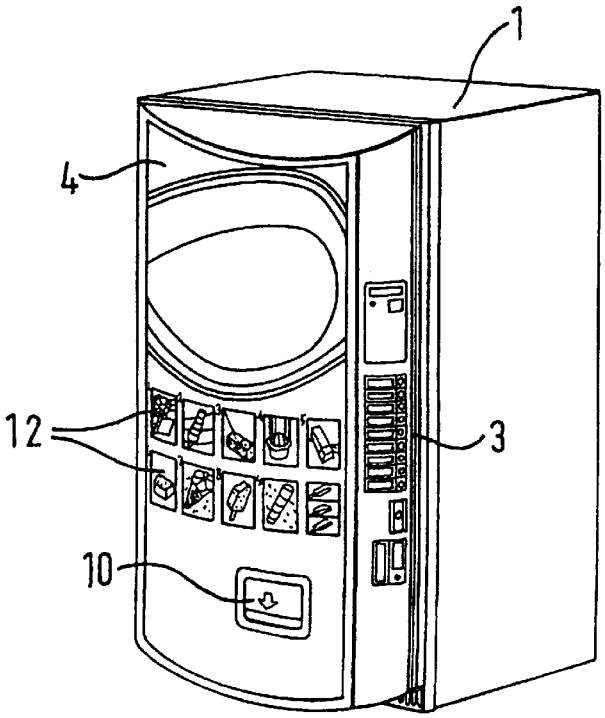
FIG. 2

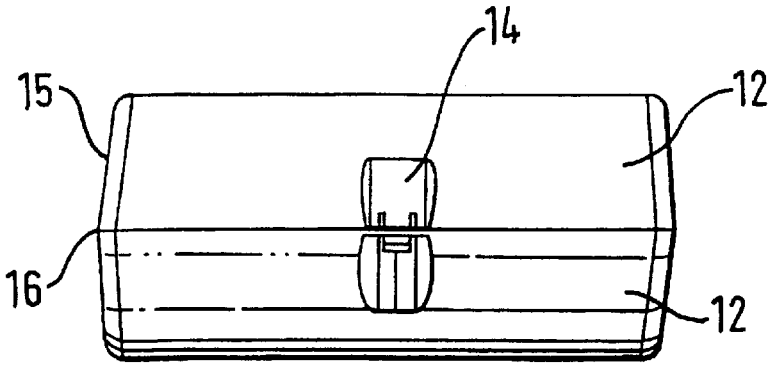
FIG. 3
FIG. 4
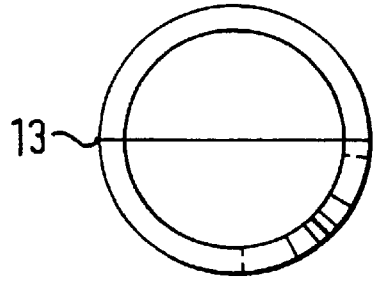
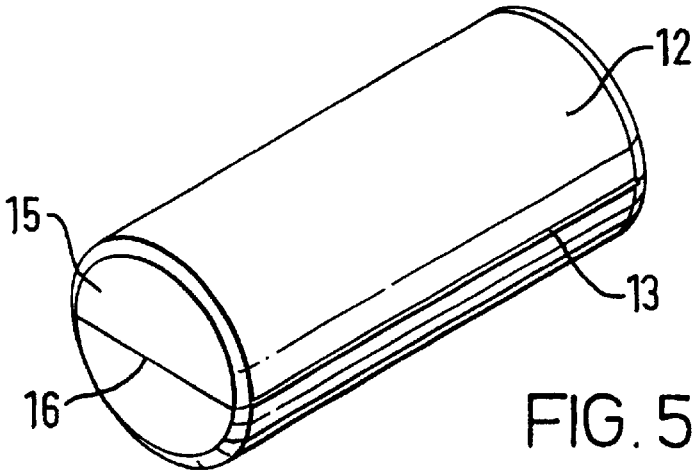
FIG. 5

CONTAINERS FOR ARTICLES OF FROZEN CONFECTIONERY

CROSS-REFERENCE TO RELATED APPLICATIONS

This application is a divisional application of application Ser. No. 09/688,547, filed Oct. 16, 2000 now U.S. Pat. No. 5,434,395, which is a continuation of the U.S. national phase designation of PCT application PCT/EP99/02418 filed Apr. 6, 1999, the contents of which are expressly incorporated herein by express reference thereto.

TECHNICAL FIELD

The present invention relates to containers and their use in an automatic vending machine for displaying and storing frozen confectionery. More specifically, the present invention relates to an automatic vending machine that can be operated for the dispensing of frozen confectionery stored in containers inside the vending machine.

BACKGROUND OF THE INVENTION

Presently, there are various types of machines for the automatic vending of products on the market. Among these, the ones most similar to this invention are machines for the vending of packaged foodstuffs and refrigerated canned drinks. Many are also designed for the vending of frozen confectionery in a frozen state.

Machines for the automatic vending of frozen confectionery are scarce, however, because the irregular-shape of the various ice cream products make them difficult to handle. Also, these machines have an operating temperature of around −18° C., and this causes ice formation which leads to costly damage. These problems explain the low rate of success of ice cream confectionery dispensing machines compared with other vending machines that operate under less exacting conditions, such as machines for dispensing refrigerated drinks.

Previous designs of automatic vending machines for frozen confectionery have had problems with ice formation mainly in the interior. This has resulted in the sticking together of the products, which in turn leads to obstruction and breakage of the delivery mechanisms. The other alternative has been to place the ice cream products in individual compartments which is quite laborious and thus disadvantageous for machine service and reloading technicians.

SUMMARY OF THE INVENTION

The invention relates to an automatic vending machine for articles of frozen confectionery. The machine includes an outer door which incorporates controls for product selection and interaction with a user, the outer door including a product collection tray for access by the user to a delivered frozen confection article; an environmentally-controlled chamber formed of thermally insulating panels located behind the outer door for receiving and conserving the frozen confection articles in containers at a freezing temperature of about −18° C.; a structure located within the environmentally-controlled chamber for delivery of the containers and articles, the structure including at least one compartment for stacking of the containers; a discharge hopper spanning the compartment for delivering a selected container and article to the product collection tray; and a delivery device located in the lower part of the compartment for seizing a bottommost container from the compartment and forwarding it into the discharge hopper.

Preferably, the delivery structure comprises parallel compartments for receiving the containers and articles in an arched arrangement forming stacks, the parallel compartments including pairs of parallel vertical dividers with a given spacing which allows the containers to fall while maintaining their vertical order. Advantageously, the machine comprises an inner door for access to the environment-controlled chamber, a flap provided in the inner door for allowing the containers and articles to pass from the discharge hopper to the product collection tray. Typically, the machine further comprises a refrigeration system having sufficient power to maintain the freezing temperature of the articles for maintaining the articles in a frozen state and a heating system preventing the formation of surface frost and ice in the containers and delivery structure.

In preferred embodiments, the containers are cylindrical or quasi-cylindrical containers, and there is provided a cash box system capable of monitoring the articles of frozen confectionery present within the machine and communicating to a remote center by telephone a need for restocking or a need for repair of any malfunction or breakdown of the machine. Also, the outer door can be provided with one or more of (a) external controls for product selection by the user and a cash box mechanism suitable for payment in cash for a selected product and dispensing of change; (b) an interactive screen with the ability to conduct promotions and provide instant prizes to the user; and (c) an audio information system equipped with preprogrammed spoken messages and musical backgrounds; or (d) means for carrying static advertising or promotional panels and moving decoration.

Another embodiment of the invention relates to a combined frozen confectionery/dispensing container for use in an automatic vending machine, which comprises two body halves joined via a longitudinal edge by means of a membrane that acts as a joint or hinge and which has a pressure-fit closure opposite the membrane, wherein the container, when open, can be stacked inside another container of similar or identical dimensions. Advantageously, the body halves are symmetrical and the container is cylindrical or quasi-cylindrical. Also, the bases of each half-cylinder or half-quasi-cylinder can include a projection formed of two inclined planes so that the container can slide easily within the compartment of the vending machine.

Preferably, the pressure-fit closure includes a tongue-and-groove or slot-and-tongue arrangement. Also, the container may be open at one end or at both ends, and provided with one or two lids of frustoconical shape, such that the frustoconical shape of the lids allows stacking of the containers in such a way as to minimize the space occupied during transportation and storage. The lids may be applied to the container using a rapid-closure system that includes a system for pressure coupling.

The invention also relates to a combined frozen confectionery/dispensing container which includes two body halves joined via a longitudinal edge by a membrane that acts as a joint or hinge and which has a pressure-fit closure opposite the membrane, wherein the container, when open, can be stacked inside another container of similar or identical dimensions. In another embodiment, the invention also relates to a combined frozen confectionery/dispensing container which includes two body halves joined via a longitudinal edge by a membrane that acts as a joint or hinge and which has a pressure-fit closure opposite the membrane, wherein the container has two ends and is open at one or both ends and forms an elongated hollow cylindrical body for holding frozen confectionery when closed and can be stacked inside another container of similar or identical dimensions when opened.

In one embodiment, the body halves are symmetrical and the container is cylindrical or quasi-cylindrical. The container could also be polyhedral, and preferred polyhedral shapes include rectangular, hexagonal, or octagonal.

In one embodiment, each half has a base that includes a projection formed of two inclined planes so that the container can slide easily within a compartment of a vending machine. In another embodiment, the pressure-fit closure includes a tongue-and-groove or slot-and-tongue arrangement. In another embodiment, the container is open at one end or at both ends, and is provided with one or two lids of frustoconical shape to permit stacking of the containers so as to minimize the space occupied. In another embodiment, each lid is applied to the container using a rapid-closure system that includes a system for pressure coupling. The membrane can be weakened to facilitate opening the container. In one embodiment, the container forms a cylinder with rounded edges but without ridges so it slides easily in the dispensing machine. In any of the container embodiments herein, it is preferred that each container includes a frozen confectionery article therein.

The invention also relates to a method of dispensing an ice confection that includes providing a plurality of containers as described above, wherein each container includes an ice confection therein, storing the containers by vertically stacking them in at least one chamber in a frozen vending machine, and dispensing each container after being paid for by a consumer wherein the container protects the frozen confectionery product during storing and dispensing.

Further the invention relates to an ice confection vending machine including a plurality of such containers therein, wherein each container to be dispensed to a customer includes an ice confection therein.

BRIEF DESCRIPTION OF THE DRAWINGS

Preferred features of the invention are now disclosed in the appended drawing figures, wherein:

FIG. 1 is a perspective view of the machine according to the invention with its doors open;

FIG. 2 is a perspective view of the machine whit the doors closed;

FIG. 3 is a front elevation of a preferred embodiment of a frozen confectionery container for use in the machine of FIGS. 1–2;

FIG. 4 is a lateral profile of the frozen confectionery container of FIG. 3;

FIG. 5 is a perspective view of the frozen confectionery container of FIG. 3;

DETAILED DESCRIPTION OF THE INVENTION

Figure 6:
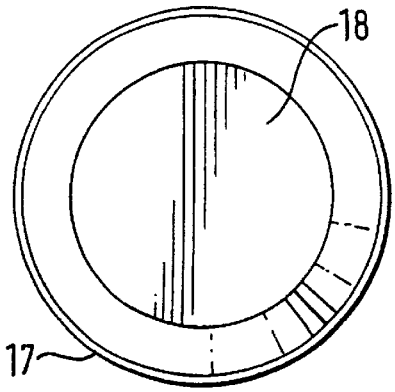
FIG. 6 is a plain view of another embodiment of a frozen confectionery container for use in the machine of FIGS. 1–2.
Figure 8:
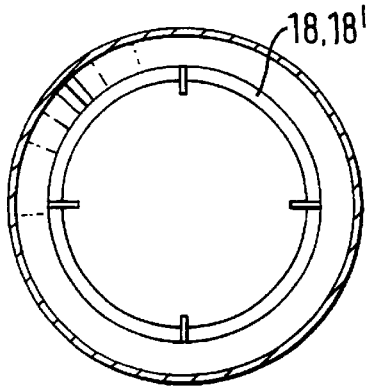
FIG. 8 is a plan view of the lid of the frozen confectionery container of FIG. 6.
Figure 7:
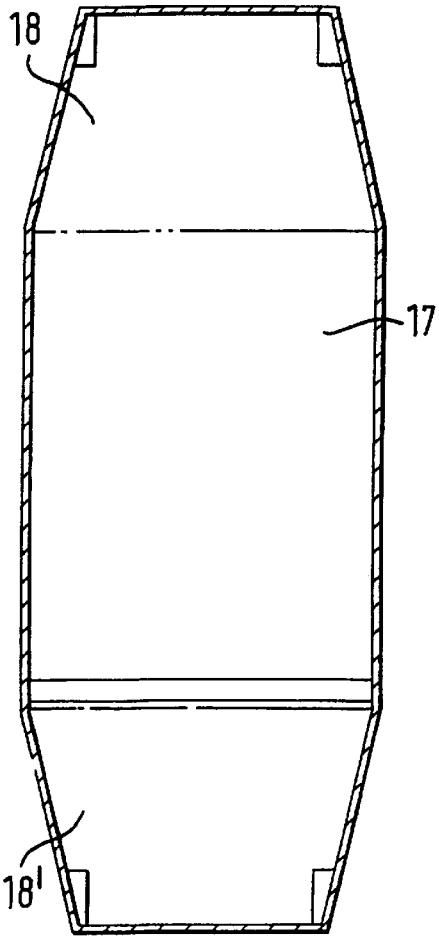
FIG. 7 is an elevational view of the frozen confectionery container of FIG. 6.
Figure 9:
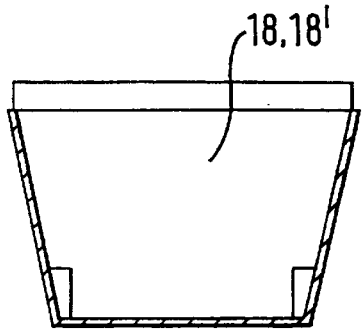
FIG. 9 is a cross-sectional view of the lid of an alternative embodiment of a frozen confectionery container.
Figure 10:
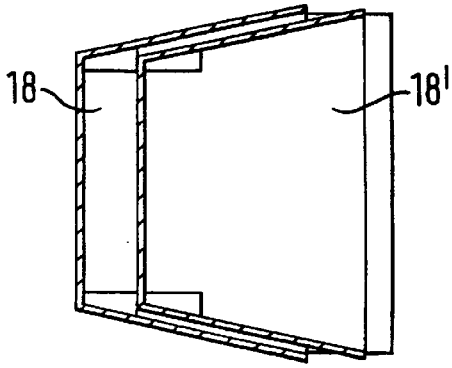
FIG. 10 illustrates a plurality of lids of the frozen confectionery container of FIG. 6 to show coupling therebetween which makes it possible to minimize the space occupied during storage of the container.

The present automatic vending machine for articles of frozen confectionery is capable of automatically delivering articles of frozen confectionery previously placed in cylindrical, quasi-cylindrical, or polyhedral containers thereby creating a suitable environment for their storage at an interior temperature of around −18° C. This machine configuration ensures reliable and secure operation due to the special design of its components. The vending machine permits rapid reloading because it avoids one-by-one manual insertion of the articles into the machine.

In the context of the invention, frozen confectionery refer to various conventional confectionery products which are molded or extruded. Examples of these confectionery products are ice sticks, cups, cones, sandwiches, or bars made of ice cream, milk ice, water ice, sherbet, or sorbet, which can be of simple or composite construction, with or without inclusions or coatings.

The machine comprises an outer body which isolates it physically and thermally from its surroundings. The machine also has an outer front door comprising control mechanisms and the user's machine operating commands. The control mechanism functions partly to prevent access to the interior of the machine. The machine's interior is protected from the outside by panels of special thermal insulating material on the walls which maintain the desired internal environment at −18° C. This temperature is achieved by means of a refrigerating compressor mounted outside the controlled-environment chamber. The machine also has an inner door, also of insulating material, which completes the insulation of the interior and which also allows access to it such as when replacing the contents of the machine. Within the environment-controlled chamber there are columns for the storage of product at the base of which are located the delivery mechanisms. The delivery mechanisms release by rotation a cylinder containing a product from the columns into a discharge hopper. The discharge hopper then delivers the product to the access opening located in the outer door for collection by the user.

To prevent ice formation within the machine, a simplified design for the delivery mechanisms and the storage structure is combined with a heating system which prevents formation of ice particles. The storage structure within the environment-controlled chamber consists of parallel vertical dividers having a space between them wherein containers containing confectionery products located in a horizontal position can be stacked one upon the other. Thus, each of the spaces between the dividers forms a compartment for each type of product. As many parallel compartments as required can be installed one alongside the other. The spacing between the dividers is such that each stack of containers remains as vertical and as ordered as possible and in the event that surface frost formed, the frost would not hinder the descent of the stack of containers.

At the base of each compartment formed by the dividers, there is a dispensing device which when caused to rotate by an electric motor seizes the bottom container of the stack allowing the container to fall downwards. The dispensing device then stops at a position at which it is again ready to release the next unit in the stack. The device is made of at least one material resistant to the operating temperatures. Moreover, the device has a simple design and a significantly reduced number of moving parts thus minimizing the likelihood of a breakdown or malfunction.

The item collected by the delivery device falls into a discharge hopper which directs it to the collection tray located in the outer door. The item then passes through an intermediate flap which separates the internal environment from the outside.

The outer door has multiple functions. It acts as a barrier to the interior of the machine, contains all the mechanisms for product selection and control of the units contained in the machine and interaction with the user. The door also contains an electronic cash receiving device capable of receiving and collecting cash and delivering change. In addition, the door comprises an advertising medium to capture possible customers and the means required for mounting promotions and dispensing prizes in situ. Thus, the door constitutes a multimedia interface incorporating a display screen, digital controls, and a voice synthesizer having an ability to produce preprogrammed spoken messages and musical backgrounds.

More specifically, the cash device and electronic system have been designed so they can perform functions such as control the general operation of the machine and monitor variables such as:

(a) the quantity and type of money inserted;

(b) the quantity and type of change to be returned to the user;

(c) the stocks of product in the machine;

(d) the stocks of cash in the box for inserted cash; and (e) the stocks of cash intended for change for the user.

Further, by an appropriate combination of electronic components this unit can be used to:

(a) transmit the product and cash stock data to a data processing center by telephone. With these data the distribution of products from the central store to the various machines in use can be optimized;

(b) report to a data processing center by telephone any damage that might have occurred to the machine so that a rapid response can be provided from a centralized technical department; and (c) provide a "user prize" system based on a random combination of different images which delivers a prize or gift when three previously determined different images are aligned.

To supplement the description and facilitate understanding of the features of the present invention, a set of illustrative-drawing figures showing details of the invention are provided. The figures are not intended to restrict in any way the scope of the present invention.

A preferred embodiment of the present invention comprises an automatic vending machine for frozen confectionery in cylindrical, quasi-cylindrical, or polyhedral containers (hereinafter "cylinders") comprising an outer body 1 whose inner walls are lined with sufficiently thermally insulating panels. The polyhedral-shaped cylinders includes rectangular, hexagonal, or octagonal-shaped containers. The insulated walls provide an environment-controlled chamber 2 at a temperature of −18° C. except at the front where there is an inner door 5 also of insulating material which completes the environment-controlled chamber 2. Chamber 2 is equipped with a lower flap and a securely locked outer door 4 on which advertising and promotional information can be placed and which houses the controls 3 for selection and interaction with the user. The controls include the corresponding buttons, a screen, and an audio system for the production of spoken messages and background music for carrying out promotions in situ. The controls are connected to the delivery devices 7 and to a cash box device 11. The cash box device 11 has the ability to receive cash and give change and also to monitor stocks at all times. The cash box device 11 also has the ability to communicate by telephone to report incidents affecting the machine such as when stocks of a particular product have run out.

Within environment-controlled chamber 2 lie compartments 6 for stacking the containers containing the frozen confectionery. The compartments are bounded by parallel vertical dividers such that the various cylinders, which lie one upon one another, are located between the arched dividers with their axes parallel to the horizontal plane. This configuration allows a customer to select a desired item. There are as many parallel compartments 6 in chamber 2 as there are selections desired for a given machine. At the base of each stacking compartment 6 there is a rotating delivery device 7 operated by an electric motor which takes the bottommost cylinder from the stack of cylinders. Upon rotation, the delivery device drops the said cylinder into the discharge hopper 8. Thereafter, the delivery device is again poised to collect the next cylinder which takes up the original position of the cylinder that was previously removed.

Discharge hopper 8 is located beneath the delivery device 7, spanning them all and emptying into a collection tray 10 through the flap provided in inner door 5, the collection tray 10 being located in outer door 4 which allows access from the outside.

To maintain chamber 2 in an environment-controlled, a refrigerating compressor of sufficient power is provided outside of chamber 2 to produce a temperature of around −18° C. at all times. Also provided is a heating system for the periodic melting of any ice particles that may have formed on the walls. The heating system thus keeps the interior of chamber 2 and the mechanisms of dispenser device 7 free from ice.

In the embodiments of the container illustrated in FIGS. 3, 4, and 5, it can be seen that the container comprises two symmetrical half-cylinders 12 joined by a membrane 13 or living hinge along a longitudinal edge. There is a tongue-and-groove closure 14 on the side opposite membrane 13, the edges corresponding to the perimeters of the bases of each half-cylinder. The bases have a projection 16 comprising two inclined planes 15 so that the container can easily slide within the machine.

In another alternative embodiment illustrated in FIGS. 6, 7, 8, 9 and 10, the container may comprise an elongated hollow cylindrical body 17 which is open at one or both ends. The open end or ends are closed off by means of lids 18, 18' of frustoconical shape, which are closed over the end walls of the body 17 using any rapid-closure system such as by means of pressure-coupling. The frustoconical shape of the lids 18, 18' permits the cylinders to be stacked up in manner indicated in FIG. 10, thus minimizing the space occupied during transportation and storage.

Figure 11:
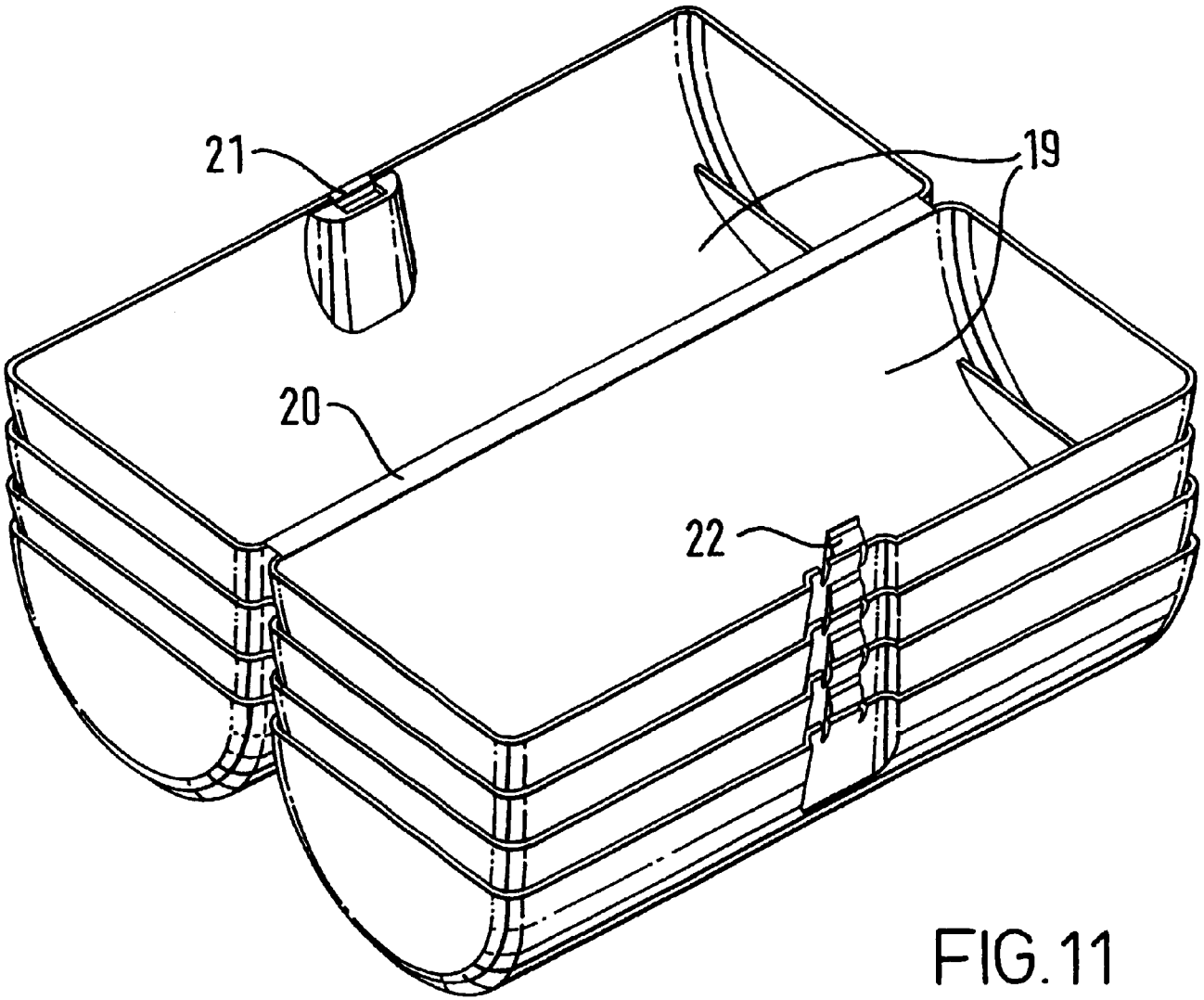
FIG. 11 is a perspective view of a stack of stored frozen confectionery containers having a different design than the containers of the other Figures.

In another embodiment of a container, as shown in FIG. 11, the container includes two identical, symmetrical halves 19 joined via a longitudinal edge by means of a weakened membrane 20 or living hinge, a pressure-fit closure which is preferably of the slot 21 and tongue 22 type. The package, when folded, forms a cylinder with rounded edges but without ridges so it slides easily inside the dispensing machine. During storage of the container, provision is provided to allow the container units to be stacked, open, one inside another to conserve space by nesting, thus preventing too tall a stack from being formed.

The above arrangements of the containers allow suitable protection of the frozen confectionery in the dispensing machine thus ensuring their effective preservation during storage so that they reach the customer in perfect condition. The frozen confectionery container may comprise an elongated cylindrical body which is open at one or both ends which can be closed by means of a cylindrical cover. The frozen confectionery containers may assume various forms and embodiments but they would nevertheless fall within the scope of the invention.

What is claimed is:

1. A combined frozen confectionery/dispensing container which comprises two body halves joined via a longitudinal edge by a membrane that acts as a joint or hinge and which has a pressure-fit closure opposite the membrane, wherein the container, when open, can be stacked inside another container of similar or identical dimensions, wherein each half has a base that includes a projection formed of two inclined planes so that the container can slide easily within a compartment of a vending machine.

2. The combined frozen confectionery/dispensing container of claim 1, wherein the container is cylindrical, quasi-cylindrical, rectangular, hexagonal, or octagonal in shape.

3. The combined frozen confectionery/dispensing container of claim 1, wherein the pressure-fit closure includes a tongue-and-groove or slot-and-tongue arrangement.

4. The combined frozen confectionery/dispensing container of claim 1, wherein each container comprises a frozen confectionery article therein.

5. A combined frozen confectionery/dispensing container which comprises two body halves joined via a longitudinal edge by a membrane that acts as a joint or hinge and which has a pressure-fit closure opposite the membrane, wherein the container, when open, can be stacked inside another container of similar or identical dimensions, wherein each half has a base that includes a projection formed of two inclined planes so that the container can slide easily within a compartment of a vending machine, wherein the container is open at one end or at both ends, and is provided with one or two lids of frustoconical shape to permit stacking of the containers so as to minimize the space occupied.

6. The combined frozen confectionery/dispensing container of claim 5, wherein each lid is applied to the container using a rapid-closure system that includes a system for pressure coupling.

7. The combined frozen confectionery/dispensing container of claim 5, wherein the container forms a cylinder with rounded edges but without ridges so it slides easily in the dispensing machine and each container comprises a frozen confectionery article therein.

8. A method of dispensing an ice confection, which comprises:

providing a plurality of containers each having a cylindrical, quasi-cylindrical, rectangular, hexagonal, octagonal shape, or a combination thereof, wherein each container includes an ice confection therein and, when open, can be stacked inside another container of similar or identical dimensions and wherein each container comprises two halves each of which has a base that includes a projection formed of two inclined planes so that the container can easily slide within at least one chamber in a vending machine;

storing the containers by vertically stacking them in the at least one chamber in the vending machine, each chamber having an interior temperature that is sufficiently low to maintain each ice confection in a frozen state; and dispensing each container after being paid for by a consumer wherein the container protects the frozen confectionery product during storing and dispensing.

9. The method of claim 8 which further comprises configuring the containers to be cylindrical or quasi-cylindrical to facilitate dispensing.

10. The method of claim 8 which further comprises maintaining the interior temperature of the chamber around −18°C.

11. The method of claim 8 wherein the containers are stacked in vertical columns in the chamber so that they can be dispensed by downward falling movement into a discharge hopper.

12. The method of claim 11, wherein the containers are stacked in a plurality of vertical columns that are spaced such that each column remains as vertical and as ordered as possible so that surface frost formation on the container does not hinder the descent of the containers during dispensing.

13. The method of claim 11 which further comprises dispensing the container occupying the lowermost position in a stacked column.

14. The method of claim 8 which further comprises periodically heating the interior of the chamber to melt ice particles that form therein on interior walls.

15. The method of claim 8 wherein each ice confection is an ice stick, cup, cone, sandwich or bar made of ice cream, milk ice, water ice, sherbert or sorbet, having a simple or composite construction and with or without inclusions or a coating.

16. An ice confection vending machine comprising a plurality of containers therein each comprising two halves each of which has a base that includes a projection formed of two inclined planes so that the container can easily slide within at least one chamber in a vending machine and each having a cylindrical, quasi-cylindrical, rectangular, hexagonal, octagonal shape, or a combination thereof, wherein each container to be dispensed to a customer includes an ice confection therein, and when open each container can be stacked inside another container of similar or identical dimensions, and wherein the vending machine provides a temperature that is sufficiently low to maintain each ice confection in a frozen state.

17. The vending machine of claim 16 wherein the containers have a cylindrical or quasi-cylindrical shape.

18. The vending machine of claim 16 wherein the containers are located in an interior chamber that is maintained at a temperature of around −18° C.

19. The vending machine of claim 16 wherein the containers are stacked in vertical columns in the chamber so that they can be dispensed by downward falling movement into a discharge hopper.

20. The vending machine of claim 19 wherein the containers are stacked in a plurality of vertical columns that are spaced such that each column remains as vertical and as ordered as possible so that surface frost formation on the container does not hinder the descent of the containers during dispensing.

21. The vending machine of claim 19 which further comprises a collection tray for dispensing containers from the stacked column.

22. The vending machine of claim 16 which further comprises a heating device for periodically heating the interior of the chamber to melt ice particles that form therein on interior walls.

23. The vending machine of claim 16 wherein each ice confection is an ice stick, cup, cone, sandwich or bar made of ice cream, milk ice, water ice, sherbert or sorbet having a simple or composite construction and with or without inclusions or a coating.

* * * * *

UNITED STATES PATENT AND TRADEMARK OFFICE

CERTIFICATE OF CORRECTION

PATENT NO. : 6,739,475 B2
DATED : May 25, 2004
INVENTOR(S) : San Martin et al.

It is certified that error appears in the above-identified patent and that said Letters Patent is hereby corrected as shown below:

Title page,
Item [62], Related U.S. Application Data, after "Division of application No. 09/688,547, filed on", change "Oct. 6, 2000" to -- Oct. 16, 2000 --.

Signed and Sealed this

Thirteenth Day of July, 2004

JON W. DUDAS
*Acting Director of the United States Patent and Trademark Office*